US007156430B2

(12) United States Patent
Hidding et al.

(10) Patent No.: US 7,156,430 B2
(45) Date of Patent: Jan. 2, 2007

(54) LATCH ASSEMBLY

(75) Inventors: Matthew L. Hidding, Elma, IA (US); Gene C. Light, Denver, IA (US); Tyler G. Larsen, Sumner, IA (US); Kelly F. Mishak, Alta Visa, IA (US)

(73) Assignee: Tri/Mark Corporation, New Hampton, IA (US)

( * ) Notice: Subject to any disclaimer, the term of this patent is extended or adjusted under 35 U.S.C. 154(b) by 197 days.

(21) Appl. No.: 10/874,085

(22) Filed: Jun. 22, 2004

(65) Prior Publication Data

US 2006/0006668 A1 Jan. 12, 2006

(51) Int. Cl.
*E05B 9/00* (2006.01)

(52) U.S. Cl. ..... 292/337; 292/216

(58) Field of Classification Search ..... 292/216, 292/201, 337; D8/343
See application file for complete search history.

(56) References Cited

U.S. PATENT DOCUMENTS 4,177,656 A * 12/1979 Davis ..... 70/84
4,838,588 A * 6/1989 Hayakawa et al. ..... 292/216
5,735,558 A * 4/1998 Watanabe ..... 292/337
5,860,683 A * 1/1999 Sekino et al. ..... 292/216
6,014,876 A * 1/2000 Taylor ..... 70/240
6,042,160 A * 3/2000 Hamada et al. ..... 292/216

* cited by examiner

*Primary Examiner*—Gary Estremsky
(74) *Attorney, Agent, or Firm*—Wood, Phillips, Katz, Clark & Mortimer

(57) ABSTRACT

A latch assembly having a housing and a catch assembly on the housing. The catch assembly has at least one catch element that is repositionable relative to the housing to change the catch assembly between first and second different states. The catch assembly in the first state is capable of preventing a strike element engaged by the latch assembly from separating from the latch assembly. The catch assembly in the second state permits a strike element, engaged by the latch assembly with the catch assembly in the first state, to be separated from the latch assembly. The housing has a base wall defining a support for at least a part of the catch assembly, a first side wall extending angularly away from the base wall, and a return wall projecting angularly away from the first side wall. At least a part of each of the base wall, first side wall, and return wall is integrally formed to define a U-shaped portion that opens in a first direction and resists deflection of the housing in response to the application of force imparted through the catch assembly to the housing in the first direction and oppositely to the first direction.

32 Claims, 5 Drawing Sheets

LATCH ASSEMBLY

BACKGROUND OF THE INVENTION

1. Field of the Invention

This invention relates to latch assemblies as used on repositionable elements, such as closure elements, and, more particularly, to a latch assembly having a catch assembly which is releasably engageable with a strike element to maintain the closure element in at least one predetermined position relative to a support for the closure element.

2. Background Art

Latch assemblies are utilized in myriad different environments for both static and dynamic applications. In one exemplary latch assembly, a catch assembly is provided within a component space defined by a housing. The catch assembly has at least first and second different states. The catch assembly includes a rotor that is in a first, primary latched position with the catch assembly in the first state and a second position with the catch assembly in the second state. In the first position, the rotor engages a strike element so as to prevent separation of the strike element from the latch assembly. With the rotor in the second position, the strike element, which is held by the latch assembly with the rotor in the first position, is permitted to be separated from the latch assembly. The rotor commonly has a third, secondary latched position, between the first and second rotor positions. With the rotor in the third position, the catch assembly is in a third state, wherein the rotor engages the strike element to prevent separation of the strike element from the latch assembly.

The rotor has a U-shaped opening to receive the strike element. With the rotor in the first position, and the strike element within the rotor opening, escape of the strike element is prohibited by a strike surface on a strike plate which blocks the rotor opening. With the strike element engaged by the latch assembly, and a closure element with which the latch assembly is associated in a first position, attempted movement of the closure element from the first position into a second position therefor causes a force to be imparted by the strike element through the rotor and strike plate to the housing. It is important that the housing does not respond to this force by deforming to the point that the strike element might escape from between the rotor and strike plate. In certain applications, such as on moving vehicle doors, the forces tending to compromise the connection of the latch assembly and strike element may be substantial. Aside from the fact that the magnitude of these forces may be quite large, governmental regulations often impose even more stringent requirements on the ability of these latch assemblies to resist these forces.

Designers of these types of latch assemblies are often faced with competing design objectives. Normally, the available space for the latch assembly is limited. Reinforcement of the housing often involves modifications which increase the perimeter dimensions of the housing. Designers of these types of latch assemblies are thus faced with the formidable task of working within the dimensional environmental constraints while affording a structure with sufficient integrity to withstand anticipated operating forces and meet related specifications established by governmental agencies.

SUMMARY OF THE INVENTION

In one form, the invention is directed to a latch assembly having a housing and a catch assembly on the housing. The catch assembly has at least one catch element that is repositionable relative to the housing to change the catch assembly between first and second different states. The catch assembly in the first state is capable of preventing a strike element engaged by the latch assembly from separating from the latch assembly. The catch assembly in the second state permits a strike element, engaged by the latch assembly with the catch assembly in the first state, to be separated from the latch assembly. The housing has a base wall defining a support for at least a part of the catch assembly, a first side wall extending angularly away from the base wall, and a return wall projecting angularly away from the first side wall. At least a part of each of the base wall, first side wall, and return wall is integrally formed to define a U-shaped portion that opens in a first direction and resists deflection of the housing in response to the application of force imparted through the catch assembly to the housing in the first direction and oppositely to the first direction.

In one form, the at least part of each of the base wall, first side wall, and return wall is defined by a single piece.

The housing may further include a cover wall. The base wall has a first substantially flat surface, with the cover wall having a second substantially flat surface. The first and second substantially flat surfaces face each other. The return wall resides between the first and second substantially flat surfaces.

The cover wall may abut to the return wall.

In one form, the housing has a second side wall projecting angularly from the base wall and the base wall and first and second side walls cooperatively define a U shape that opens in a direction transversely to the first direction.

In one form, the housing has a length, a width, and a thickness. The U-shaped portion extends over a majority of the length of the housing.

In one form, the base wall extends over substantially the full width of the housing and the return wall extends over less than the full width of the housing.

The return wall may extend over less than one half the width of the housing.

In one form, the housing has a generally U-shaped opening that opens in the first direction and within which a strike element engaged by the catch assembly resides with the catch assembly in the first state.

In one form, the U-shaped opening is defined through each of the base wall and the cover wall.

At least one axle may connect between the base wall and cover wall to maintain the base wall and cover wall in a fixed relationship.

In one form, the at least one repositionable catch element is a rotor that is guided in pivoting movement relative to the axle between first and second positions. The rotor is in the first position with the catch assembly in the first state and in the second position with the catch assembly in the second state.

The housing may include a second side wall projecting angularly from the base wall. The base wall and first and second side walls cooperatively define a U shape that opens in a direction transversely to the first direction. The second side wall extends over a distance substantially less than the length of the housing.

The base wall may have an integral bent end which extends upwardly to the cover wall.

The latch assembly may be provided in combination with a repositionable closure element to which the latch assembly is mounted. The repositionable closure element is mounted for movement relative to a support with a strike element between first and second positions. With the repositionable closure element in the first position, the strike element is engaged with the catch assembly and the catch assembly is in the first state.

The latch assembly may be provided further in conjunction with a release assembly for selectively causing the catch assembly to be changed from the first state into the second state.

In one form, the at least one repositionable catch element is a rotor that is movable relative to the housing between a first position and second position. The rotor is in the first position with the catch assembly in the first state and in the second position with the catch assembly in the second state. The rotor is normally biased towards the second position. The latch assembly may further include a latch element that is movable between a latched position and a release position. The latch element in the latched position prevents the rotor from moving from the first position into the second position. The latch element in the release position allows the rotor to move from the first position into the second position.

In one form, the latch element is engageable with the rotor in a third position between the first and second positions. With the rotor in the third position and the latch element in the latched position, the latch element prevents the rotor from moving from the third position into the second position.

The latch assembly may be provided further in combination with an operator for changing the latch element from the latched position into the release position.

The invention is further directed to a latch assembly having a housing and a catch assembly on the housing. The catch assembly has at least one catch element that is repositionable relative to the housing to change the latch assembly between first and second different states. The catch assembly in the first state is capable of preventing a strike element engaged by the latch assembly from separating from the latch assembly. The catch assembly in the second state permits a strike element, engaged by the latch assembly with the catch assembly in the first state, to be separated from the latch assembly. The housing has a base wall defining a support for at least a part of the catch assembly and having a first substantially flat surface bounding a component space within which the catch assembly resides. The cover wall has a second substantially flat surface facing the first substantially flat surface and bounding the component space. The return wall resides between the base wall and cover wall and has third and fourth oppositely facing surfaces respectively facing the first and second substantially flat surfaces. The base wall, cover wall, and return wall are fixed in relationship to each other.

The housing may further have a side wall extending between the base wall and return wall.

In one form, the housing has a length, a width, and a thickness. The base wall and cover wall extend over substantially the full width of the housing, with the return wall extending over less than the full width of the housing.

In one form, the return wall extends over less than one half of the width of the housing.

In one form, the housing has a generally U-shaped opening defined through each of the base wall and cover wall within which a strike element engaged by the catch assembly resides with the catch assembly in the first state.

In one form, at least one axle connects between the base wall and cover wall to maintain the base wall and cover wall in a fixed relationship.

In one form, the at least one repositionable catch element is a rotor that is guided in pivoting movement relative to the axle between first and second positions. The rotor is in the first position with the catch assembly in the first state and in the second position with the catch assembly in the second state.

The latch assembly may be provided in combination with a repositionable closure element to which the latch assembly is mounted. The repositionable closure element is mounted for movement relative to a support with a strike element between first and second positions. With the repositionable closure element in a first position, the strike element is engaged with the catch assembly and the catch assembly is in the first state.

The catch assembly may be provided further in combination with a release assembly for selectively causing the catch assembly to be changed from the first state into the second state.

In one form, the at least one repositionable catch element is a rotor that is movable relative to the housing between a first position and a second position. The rotor is in the first position with the catch assembly in the first state and in the second position with the catch assembly in the second state. The rotor is normally biased towards the second position. The catch assembly may further include a latch element that is movable between latched and release positions. The latch element in the latched position prevents the rotor from moving from the first position into the second position. The latch element in the release position allows the rotor to move from the first position into the second position.

The latch element may be engageable with the rotor with the rotor in a third position between the first and second positions. With the rotor in the third position and the latch element in the latched position, the latch element prevents the rotor from moving from the third position into the second position.

The latch assembly may be provided further in conjunction with an operator for changing the latch element from the latched position into the release position.

DETAILED DESCRIPTION OF THE DRAWINGS

Figure 1:
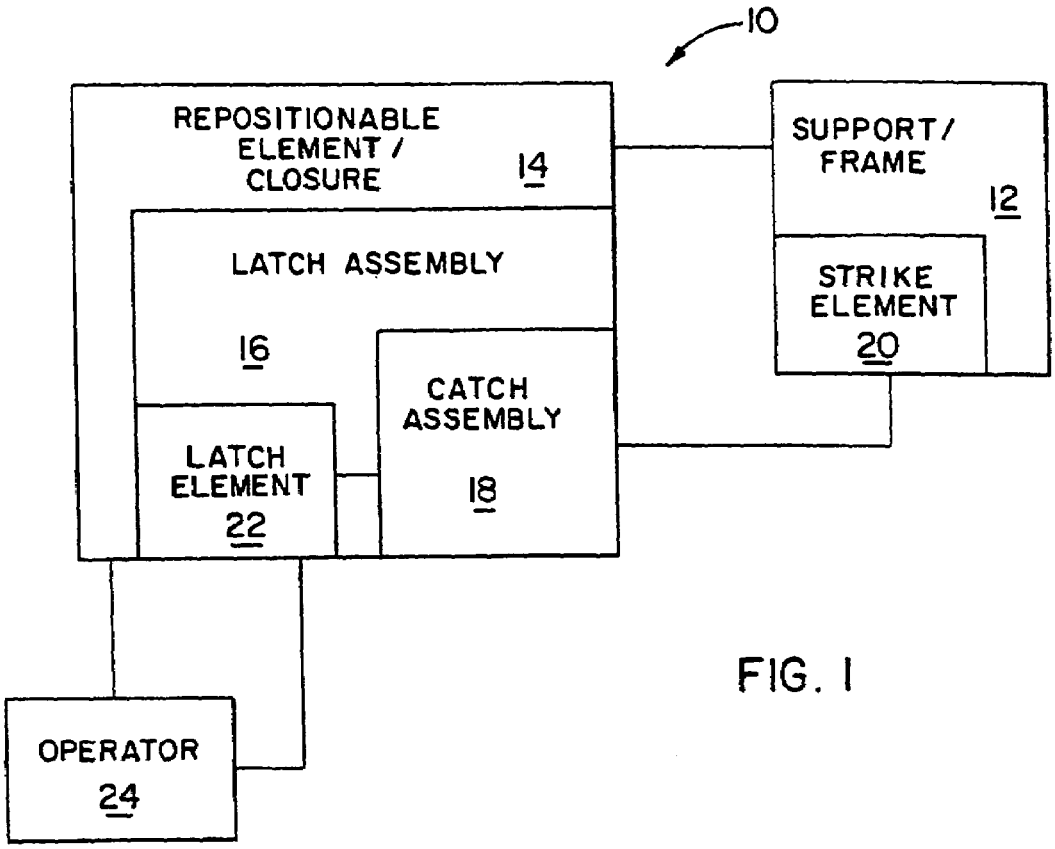
FIG. 1 is a schematic representation of a system including a repositionable element/closure mounted movably upon a support/frame and including a latch assembly, according to the present invention, which cooperates with a strike element on the support/frame to releasably maintain the repositionable element/closure in at least one predetermined position.
Figure 2:
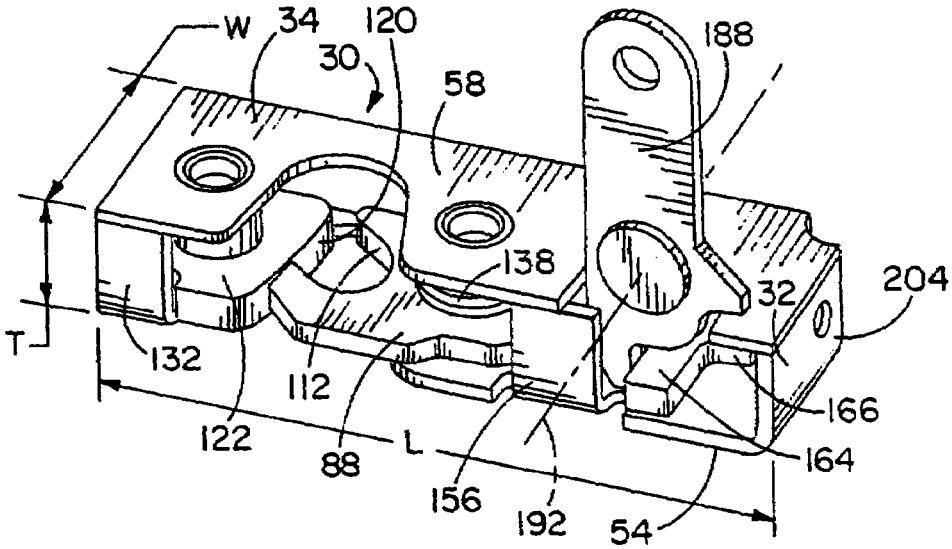
FIG. 2 is a perspective view of one form of the inventive latch assembly on the system in FIG. 1 and including a multi-part housing with a catch assembly having a rotor that is movable between first and second positions, corresponding to first and different states for the catch assembly, to selectively hold and release the strike element, respectively, and with the rotor in the first position.
Figure 3:
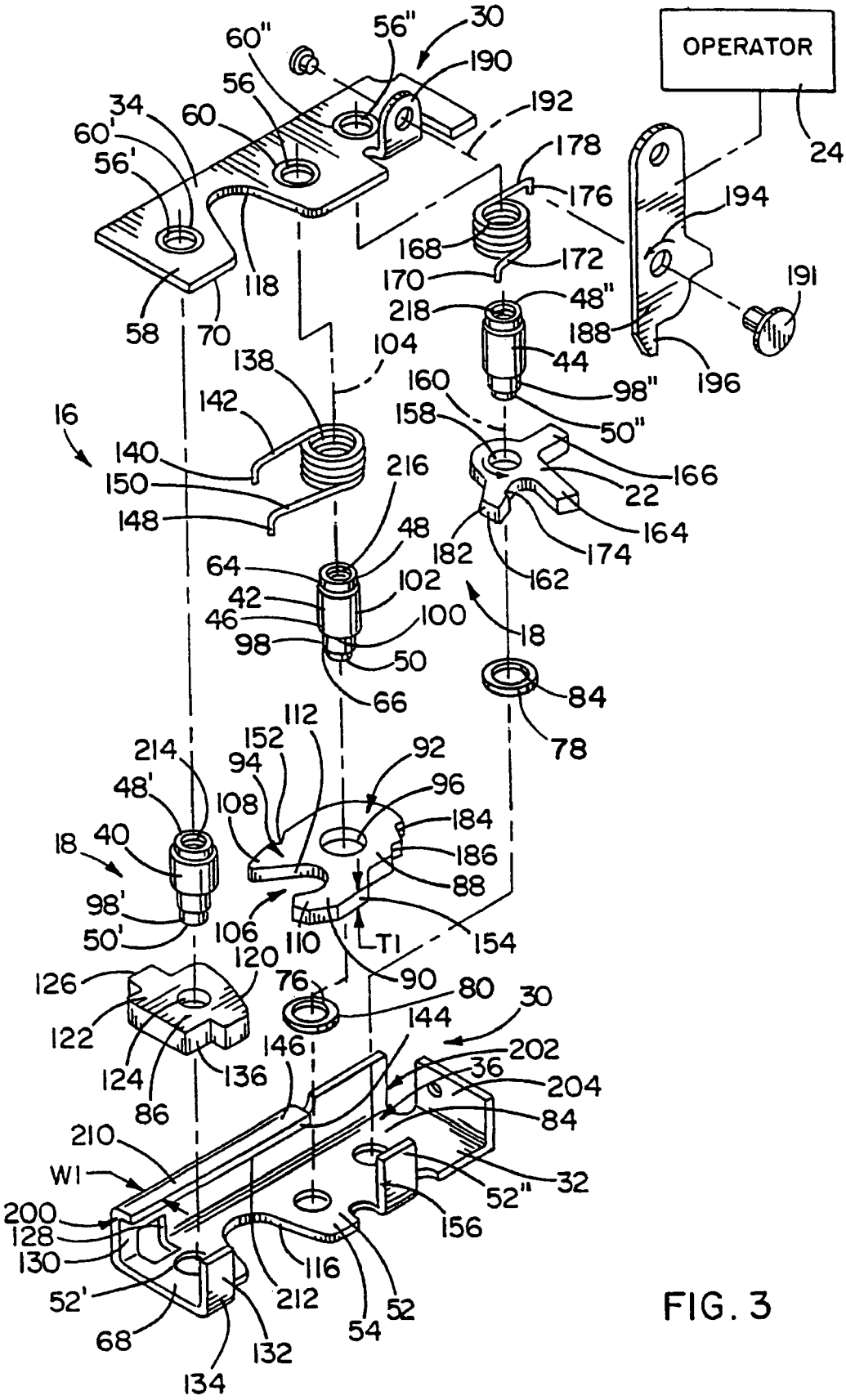
FIG. 3 is a reduced, exploded, perspective view of the inventive latch assembly in FIG. 2.
Figure 4:
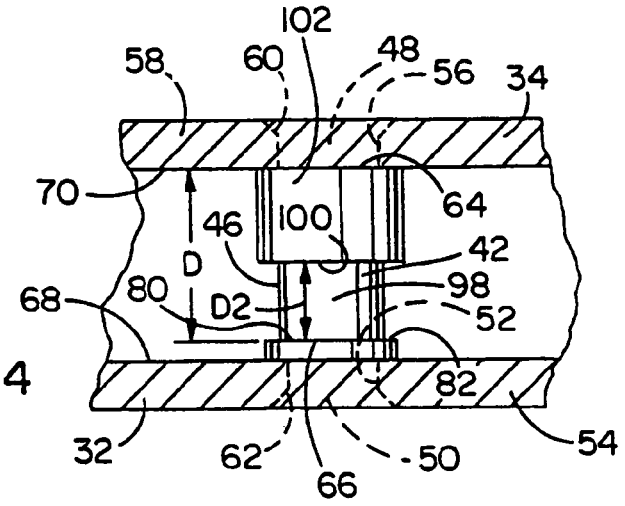
FIG. 4 is an enlarged, fragmentary, partial cross-sectional view of a connection between an axle and two housing parts on the latch assembly in FIG. 2.
Figure 5:
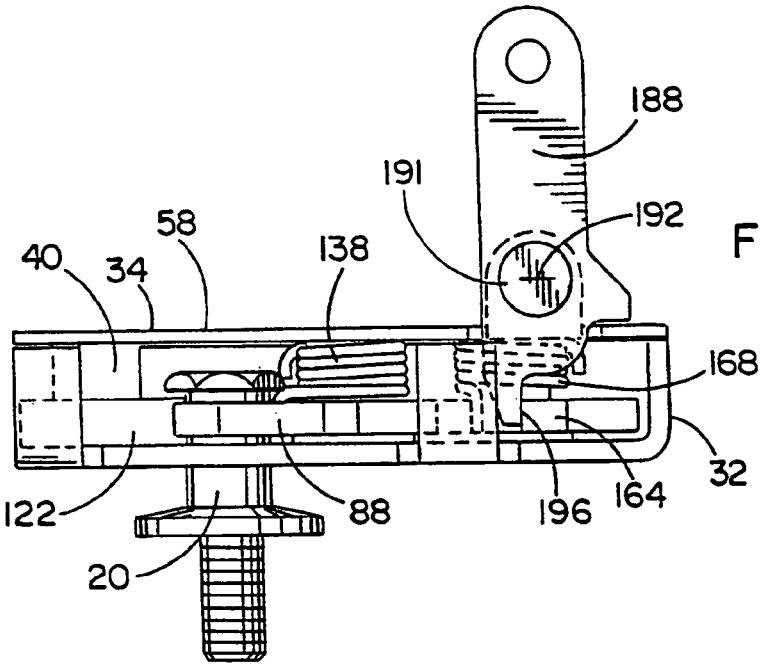
FIG. 5 is a side elevation view of the inventive latch assembly in the FIG. 2 state and with the strike element of FIG. 1 engaged by the rotor with the rotor in its first position.
Figure 6:
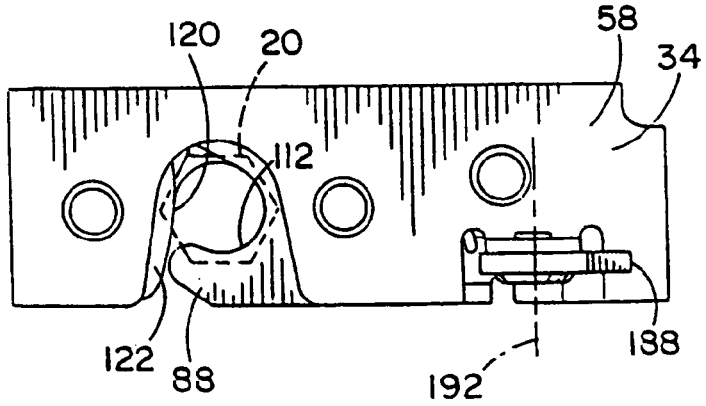
FIG. 6 is a plan view of the inventive latch assembly in the FIG. 5 state.

In FIG. 1, an exemplary system, which represents a suitable environment for the present invention, is shown at 10. The system 10 consists of a support/frame 12 on which a repositionable element 14 is attached for selective movement between first and second different positions. The system 10 may be in either a static or dynamic environment. As one example, the support/frame 12 may be a fixed structure such as a building or a cabinet. The repositionable element 14 may be in the form of a closure, or virtually any element which is required to be placed in two different positions for normal operation.

According to the invention, the repositionable element/closure 14 has a latch assembly 16 carried thereon with a catch assembly 18 that cooperates with a strike element 20 on the support/frame 12. The latch assembly 16 is designed to releasably maintain the repositionable element/closure 14 in its first position with the latch assembly 16 in a first state. By changing the latch assembly 16 into a second state, the strike element 20 can be released from the catch assembly 18 to allow the repositionable element/closure 14 to be placed in its second position. The latch assembly 16 has a latch element 22 that is movable between a latched position and a release position through an operator 24 to respectively a) maintain the catch assembly 18 in the first state and b) allow the catch assembly 18 to be changed from the first state into the second state.

As shown more specifically in FIGS. 2–10, the latch assembly 16 has a housing 30 defined by joinable first and second housing parts 32, 34 which are joined to cooperatively define a component storage space at 36 for, in this case, the catch assembly at 18. The housing 30 has a generally squared/rectangular perimeter shape with a length (L), a width (W) and a thickness (T). The precise shape of the housing 30 is not critical to the present invention.

The housing parts 32, 34 are maintained in fixed relationship by, in this embodiment, three similarly configured axles 40, 42, 44. Exemplary axle 42 has a cylindrical body 46 and axially spaced, reduced diameter ends 48, 50, as shown most clearly in FIGS. 3 and 4. The end 50 is directed through a bore 52 through a base wall 54 on the housing part 32. The other end 48 extends through a bore 56 in a cover wall 58 defining the second housing part 34. The cover wall 58 is substantially flat over its entire area within a peripheral edge thereon. The bore 56 has a surrounding bevel 60 with the bore 52 having a like surrounding bevel 62.

The reduced diameter ends 48, 50 define oppositely facing, annular shoulders 64, 66 which are spaced a distance D to establish the desired spacing between a flat surface 68 on the base wall 54 and a facing flat surface 70 on the cover wall 58, with the latter abutting to the shoulder 64 with the housing 30 assembled. The axle ends 48, 50 are radially deformed, through a swaging process, or otherwise, to conform them to the beveled surfaces 60, 62 in such a manner that the base wall 54 and cover wall 58 are drawn tightly towards each other and against the shoulders 64, 66, respectively, to unitize the axle 42 and housing parts 32, 34.

The axle 40 has a stepped outer diameter and reduced diameter ends 48', 50' which extend through bores 56', 52', with surrounding bevels 60' (one shown), on the cover wall 58 and base wall 54, respectively.

The axle 44 also has a stepped outer diameter with reduced diameter ends 48", 50" extending through bores 56", 52", with surrounding bevels 60" (one shown) on the cover wall 58 and base wall 54, respectively.

Spacing rings 76, 78, formed separately from, or as one piece with, the base wall 54, define bearing support surfaces 80, 84. Separate, cooperating, components 86, 88, with the latter a pivotable rotor, are mounted to the housing part 32. The component 86 is a strike plate that bears directly against the housing surface 68. The rotor 88 is moved guidingly against the bearing support surface 80. The latch element 22 is moved guidingly against the bearing support surface 84.

The rotor 88 has a body 90 with a mounting portion 92 and a receiving portion at 94 for the strike element 20. The mounting portion 92 of the body 90 has a through bore 96 to receive a reduced diameter portion 98 of the axle 42. An annular shoulder 100 between the reduced diameter portion 98 and a larger diameter portion 102 is spaced a distance D2 (FIG. 4) from the bearing support surface 80. The distance D2 is slightly greater than the thickness T1 (FIG. 3) of the body 90 of the rotor 88 so that the rotor 88 is confined against axial movement but will not bind with the housing 30 as it pivots in operation.

Figure 7:
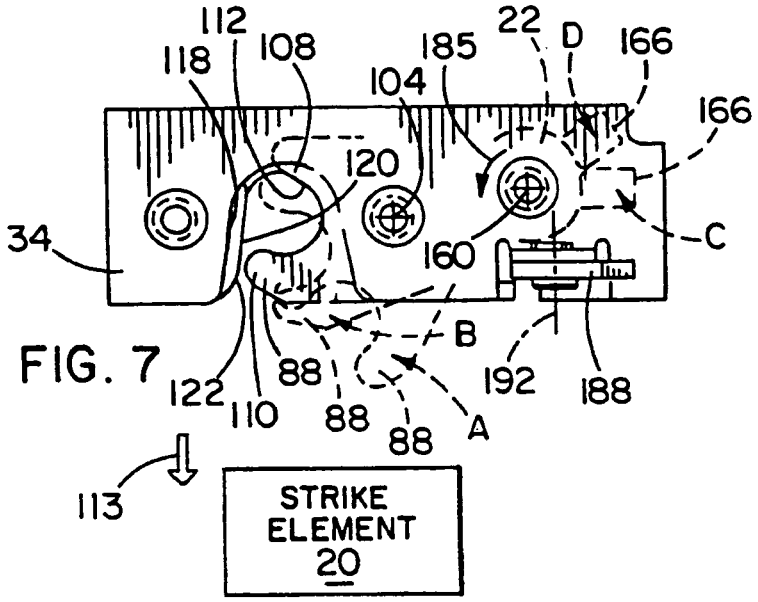
FIG. 7 is a view of the inventive latch assembly as in FIG. 5 and showing the rotor in a second position in phantom lines and showing the latch element in FIG. 1 in latched and release positions.
Figure 8:
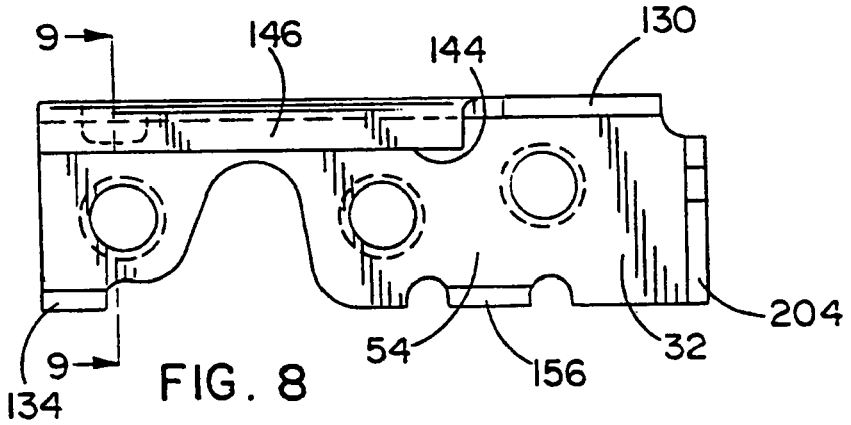
FIG. 8 is a plan view of one of the housing parts on the inventive latch assembly.
Figure 9:
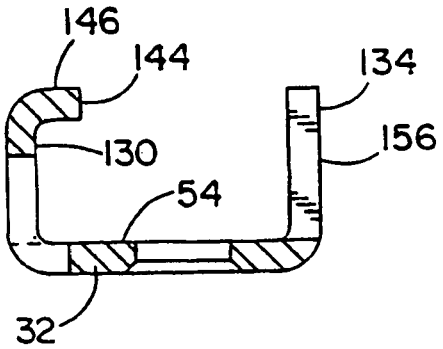
FIG. 9 is an enlarged, cross-sectional view of the housing part taken along line 9—9 of FIG. 8.
Figure 10:
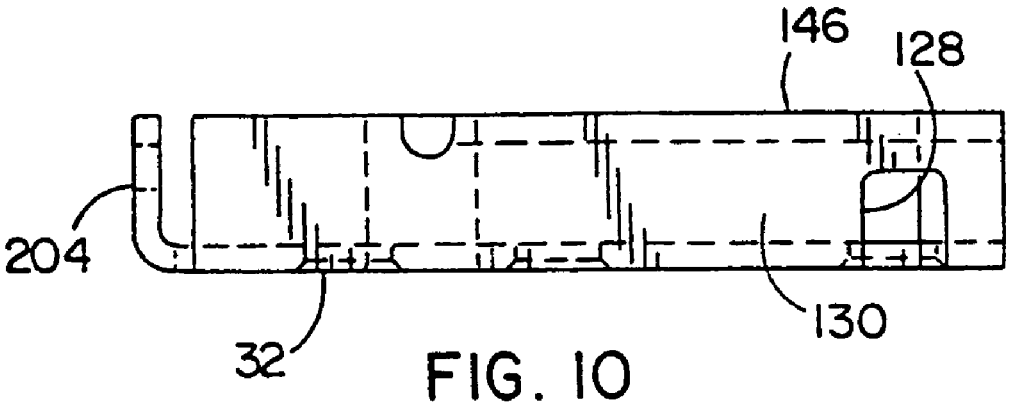
FIG. 10 is an elevation view of the housing part in FIG. 9 taken from the side opposite that in FIG. 5.

The reduced diameter portion 98 of the axle 42 is dimensioned to be closely received within the bore 96 so as to guide pivoting movement of the rotor 88 about the axis 104 between a first position, shown in FIGS. 2, 5, 6 and 7, and a second position, shown in dotted lines in FIG. 7 at A.

The receiving portion 94 of the rotor 88 has an opening 106 which bifurcates the receiving portion 94 so as to define spaced legs 108, 110 between which a throat is defined to accept the strike element 20. The opening 106 is bounded by a U-shaped edge 112.

As seen in FIG. 7, with the rotor 88 in the second position therefor, and the repositionable element/closure 14 to which the latch assembly 16 is mounted in its first position, which may be an open position, movement of the repositionable element/closure 14 towards its second/closed position and towards the strike element 20, as indicated by the arrow 113, causes the strike element 20 to bear on the edge 112 on the leg 108. Continued movement of the repositionable element/closure 14 towards its second position causes the strike element 20 to pivot the rotor around the axis 104 fully into the first position for the rotor 88.

In the first position for the rotor 88, the strike element 20 within the rotor opening 106 resides fully within the width dimension of the housing 30. This is permitted by having U-shaped, coincident openings 116, 118 in the base wall 54 and cover wall 58, respectively. With the rotor 88 in the first position therefor, escape of the strike element 20 from the rotor opening 106 is blocked by a strike surface 120 on a strike plate 122, which bridges the legs 108, 110 on the rotor 88 and resides in close proximity thereto.

The strike plate 122 has a through bore 124 which receives a reduced diameter portion 98' of the axle 40. The strike plate 122 is keyed against movement around the axle 40 by a tab 126 which projects into a receptacle 128 through a side wall 130 on the housing part 32. Additional keying is afforded by a tab 132 defining part of an opposite, second side wall 134 which seats in an undercut 136 on the strike plate 122.

The rotor 88 is normally biased towards its second position by a coiled torsion spring 138 which surrounds the larger diameter portion 102 of the axle 42. A first offset 140 on one cantilevered end arm 142 on the spring 138 bears against an edge 144 on a return wall 146, projecting from the side wall 130 towards the opposite side wall 134. A second offset 148 on an end arm 150 on the torsion spring 138 nests in a receptacle 152 on the rotor 88. The torsion spring 138 is loaded between the edge 144 on the return wall 146 and the edge bounding the receptacle 152 on the rotor 88 to bias the rotor 88 towards its second position. The second position for the rotor 88 is consistently maintained by the abutment of an edge 154 on the rotor 88 to a tab 156 that defines part of the side wall 134.

The latch element 22 has a through bore 158 to accept a reduced diameter portion 98" of the axle 44, which guides movement of the latch element 22 around an axis 160 between a latched position, and a release position, shown in phantom lines in FIG. 7 at C and D, respectively. The latch element 122 has a latching arm 162, an operating arm 164, and a stop arm 166, each projecting radially from the axis 160 and spaced circumferentially therearound. The latch element 22 is normally biased into its latched position by a coiled torsion spring 168 with a first offset 170 on one cantilevered end arm 172, which nests in a receptacle 174 on the latch arm 162. A second offset 176 on a second cantilevered end arm 178 bears against a surface 180 of the side wall 130. The torsion spring 168 is loaded between the latch arm 162 and wall surface 180 to produce the desired operating torque on the latch element 22.

With the rotor 88 in the first position therefor, and the latch element in its latched position, the free end 182 on the latch element 22 abuts to an undercut stop surface 184 on the rotor 88 to maintain the rotor 88 in its first position. By pivoting the latch element 22 in the direction of the arrow 185 in FIG. 7, from its latched position at C towards its release position at D, the free end 182 clears the stop surface 184 to allow the rotor 88 to pivot under the torsion force from the spring 138 to a point that the free end 182 abuts a second stop surface 186 on the rotor 88 which is thereby maintained in a third position at B (FIG. 7), between the first and second positions, previously described. The first rotor position represents a primary latched position, with the third position of the rotor 88 representing a secondary latched position for the rotor 88.

The latch element 22 is repositionable from its latched position into its release position through a release assembly, including a latch lever 188, which is mounted to an offset tab 190 on the cover wall 58 by a pin 191 for pivoting movement around an axis 192. Pivoting movement of the latch lever 188 in the direction of the arrow 194 around the axis 192 causes an actuating leg 196 to bear against the operating arm 164 on the latch element 22 to the point that the stop arm 166 bears against the wall surface 180, representing the release position for the latch element 22. As previously noted, the latch lever 188 can be repositioned either at the site of the latch lever 188 or remotely therefrom by any type of operator 24, known to those skilled in the art or that might be readily devised by someone skilled in the art.

The present invention is concerned primarily with the configuration of the housing 30. The components described herein, i.e. catch assembly 18, etc. are intended to be exemplary in nature only. The inventive concept can be practiced with other types of catch assemblies, including those utilizing multiple, cooperating rotor elements to hold a strike element. The present invention is focused in part on addressing the ability of the housing 30 to withstand loading through the repositionable element/closure 14, with the rotor 88 maintaining the strike element 20 in each of its primary and secondary latched positions.

Figure 11:
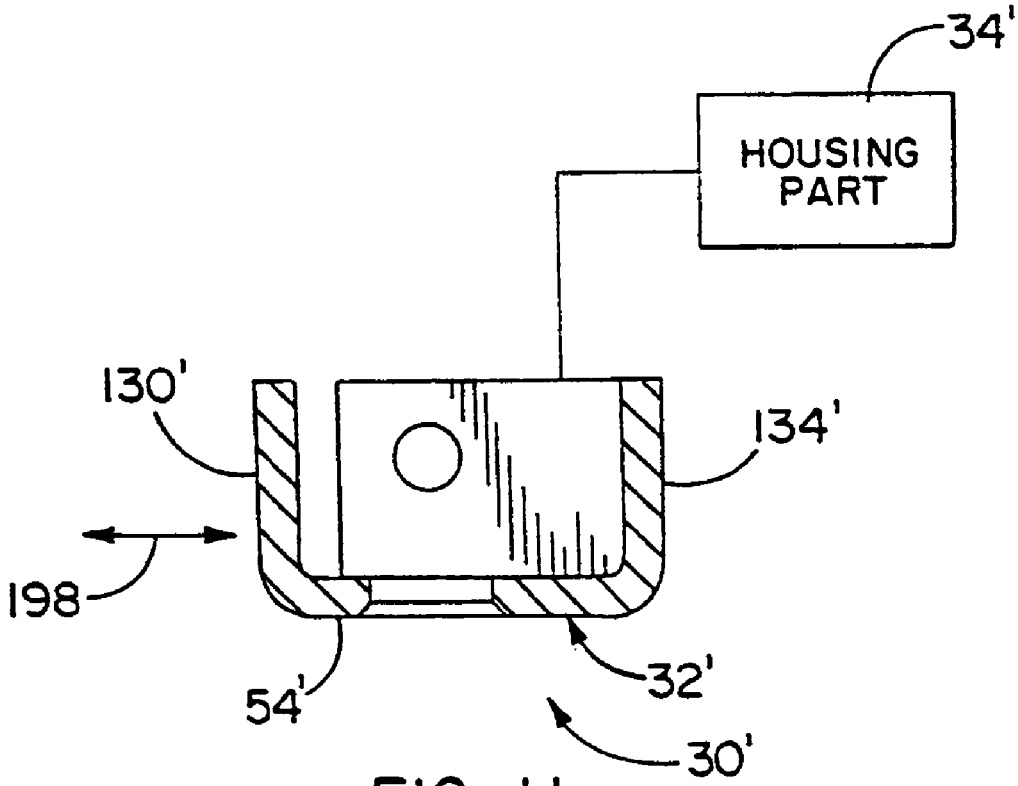
FIG. 11 (PRIOR ART)
FIG. 11 is a view as in FIG. 9 of a conventional housing part corresponding to that in FIG. 9.

The significance of the present invention can be appreciated by reference to FIG. 11, which shows the configuration of a housing 30' currently offered by the assignee herein, with joinable housing parts 32', 34'. The housing part 32' has a base wall 54' and side walls 130', 134'. With the strike element 20 engaged by a rotor (not shown) on the housing 30', and the rotor in either primary or secondary latched positions, forces exerted on the repositionable element/closure 14 are imparted to the rotor through the strike element 20 and therefrom to the housing 30' in the line of the double-headed arrow 198. This tends to cause a bowing deflection of the side wall 130' which, in extreme loading situations, could compromise the engagement between the rotor and strike element 20.

According to the invention, the housing 30 is reinforced by the return wall 146, which resides between the cover wall 58 and base wall 54. The return wall 146 effectively acts as a reinforcing beam along the length of the side wall 130 to enhance its rigidity to allow the side wall 130 to withstand greater forces before deflecting/bending to an extent that the strike element 20 releases from the rotor 88. Preferably, the base wall 54, side wall 130, and return wall 146 are integrally formed and, more preferably, formed as one piece so as to define a U-shaped portion opening in the line of the anticipated transverse forces encountered during operation. The U-shaped portion consists of a base and spaced first and second legs projecting away from the base in a common direction, wherein: the base is defined by the side wall 130, the first leg is defined by the base wall 54, and the second leg is defined by the side wall 146.

The return wall 146 has a width dimension W1 (FIG. 3) that is substantially less than the width W of the housing 30. In a preferred form, the width W1 is less than one half the width W and is selected so that the edge 144 thereof does not occupy space that is required for the operating components, namely the torsion springs 138, 168 on their respective axles 42, 44. In fact, the edge 144 is conveniently usable, as shown, to load the torsion spring 138.

In this embodiment, the return wall 146 extends from one housing end 200 approximately two thirds of the length L towards the opposite housing end 202. By eliminating the return wall 146 at the end 202, more space is afforded in the region of the axle 44 which resides closer to the side wall 130 than do the other axles 40, 42. The return wall 146 could, however, extend the full length of the housing 30. However, the configuration shown provides the required strengthening in the region at which the strike element 20 is engaged by the rotor 88. Additional rigidity is built into the housing by bending the base wall to define an end 204 that projects to the cover wall 58.

The return wall 146 can be incorporated between the flat surface 68 on the base wall 54 and the facing flat surface 70 on the cover wall 58 without requiring an increase in the overall thickness T for the housing 30. Thus, additional rigidity, compared to the housing 30', is afforded within the same perimeter dimensions. The formed axles 40, 42, 44 may draw the cover wall 58 into abutting relationship with the return wall 146 to unitize the housing 30. The return wall 146 has oppositely facing surfaces 210, 212, with the former abuttable to the cover wall 58 and the latter facing the base wall surface 68.

To facilitate mounting of the latch assembly 16 to the repositionable element/closure 14, the axles 40, 42, 44 have threaded through bores 214, 216, 218, respectively to accommodate a complementarily threaded fastener.

Since the side wall 134 is not subjected to substantial loading forces, it is not required to extend any substantial length along the housing 30. Instead, the tabs 132, 156 on the side wall 134 which, in conjunction with the base wall 54 and side wall 130 define a U shape opening transversely to the loading direction identified by the arrow 198 (FIG. 11) are provided, primarily to facilitate keyed mounting of the strike plate and limit pivoting of the rotor 88, rather than to contributing to structural integrity. The "U" consists of a base and spaced first and second legs projecting away from the base in a common direction, wherein: the base is defined by the base wall 54, the first leg is defined by the side wall 130, and the second leg is defined by the side wall 134.

Another U shape, opening transversely to the U shape defined by the base wall 54 and side wall 134 is defined by the base wall 54, second side wall 134, and side wall 130. The second base of the "U" is defined by the base wall 54 with third and fourth spaced legs of the U projecting in a common direction from the base defined by the side walls 130, 134.

The foregoing disclosure of specific embodiments is intended to be illustrative of the broad concepts comprehended by the invention.

The invention claimed is:

1. A latch assembly comprising:

a housing; and a catch assembly on the housing, the catch assembly comprising at least one catch element that is repositionable relative to the housing to change the catch assembly between first and second different states, the catch assembly in the first state capable of preventing a strike element engaged by the latch assembly from separating from the latch assembly, the catch assembly in the second state permitting a strike element engaged by the latch assembly with the catch assembly in the first state to be separated from the latch assembly, the housing comprising a base wall having a first substantially flat surface residing in a first plane and defining a support for at least a part of the catch assembly, a first side wall extending angularly away from the base wall, and a return wall projecting angularly away from the first side wall, at least a part of each of the base wall, first side wall and return wall integrally formed to define a U-shaped portion, consisting of a base and spaced first and second legs projecting away from the base in a common direction, that opens in a first direction and resists deflection of the housing in response to the application of a force imparted through the catch assembly to the housing in the first direction and oppositely to the first direction, wherein the base is defined by the first side wall, the first leg is defined by the base wall, and the second leg is defined by the return wall, wherein at least one axle is fixed on and projects from the base wall, wherein the at least one repositionable catch element comprises a rotor that is guided in pivoting movement by and relative to the axle about an axis that is substantially orthogonal to the first plane between first and second positions, the rotor in the first position with the catch assembly in the first state and in the second position with the catch assembly in the second state.

2. The latch assembly according to claim 1 wherein the at least part of each of the base wall, first side wall, and return wall is defined by a single piece.

3. The latch assembly according to claim 1 wherein the housing further comprises a cover wall, the base wall has a first substantially flat surface, the cover wall has a second substantially flat surface, the first and second substantially flat surfaces face each other, and the return wall resides between the first and second substantially flat surfaces, the at least one axle fixed to the cover wall.

4. The latch assembly according to claim 3 wherein the cover wall abuts to the return wall.

5. The latch assembly according to claim 3 wherein the at least one axle connects between the base wall and cover wall to maintain the base wall and cover wall in a fixed relationship.

6. The latch assembly according to claim 3 wherein the base wall has an integral bent end that projects upwardly to the cover wall.

7. The latch assembly according to claim 1 wherein the housing comprises a second side wall projecting angularly from the base wall and the base wall and first and second side walls cooperatively define a U shape that opens in a direction transversely to the first direction and consisting of a second base and spaced third and fourth legs projecting away from the second base in a common direction, wherein the second base is defined by the base wall, the third leg is defined by the first side wall and the fourth leg is defined by the second side wall.

8. The latch assembly according to claim 1 wherein the housing has a length, a width, and a thickness, and the U-shaped portion extends over a majority of the length of the housing.

9. The latch assembly according to claim 8 wherein the base wall extends over substantially the full width of the housing and the return wall extends over less than the full width of the housing.

10. The latch assembly according to claim 9 wherein the return wall extends over less than one half the width of the housing.

11. The latch assembly according to claim 8 wherein the housing comprises a second side wall projecting angularly from the base wall, the base wall and first and second side walls cooperatively define a U shape that opens in a direction transversely to the first direction and consisting of a second base and spaced third and fourth legs projecting away from the second base in a common direction, wherein the second base is defined by the base wall, the third leg is defined by the first side wall and the fourth leg is defined by the second side wall, and the second side wall extends over a distance substantially less than the length of the housing.

12. The latch assembly according to claim 1 wherein the housing has a generally U-shaped opening that opens in the first direction and within which a strike element engaged by the catch assembly resides with the catch assembly in the first state.

13. The latch assembly according to claim 12 wherein the housing further comprises a cover wall, the base wall has a first substantially flat surface, the cover wall has a second substantially flat surface, the first and second substantially flat surfaces face each other, the return wall resides between the first and second substantially flat surfaces, and the U-shaped opening is defined through each of the base wall and the cover wall.

14. The latch assembly according to claim 1 in combination with a repositionable closure element to which the latch assembly is mounted, the repositionable closure element mounted for movement relative to a support with a strike element between first and second positions, and with the repositionable closure element in the first position the strike element is engaged with the catch assembly and the catch assembly is in the first state.

15. The latch assembly according to claim 14 further comprising a release assembly for selectively causing the catch assembly to be changed from the first state into the second state.

16. The latch assembly according to claim 15 wherein the rotor is movably biased toward the second position, and the latch assembly further comprises a latch element that is movable between a latched position and a release position, the latch element in the latched position preventing the rotor from moving from the first position into the second position, the latch element in the release position allowing the rotor to move from the first position into the second position.

17. The latch assembly according to claim 16 wherein the latch element is engagable with the rotor with the rotor in a third position between the first and second positions and with the rotor in the third position and the latch element in the latched position, the latch element prevents the rotor from moving from the third position into the second position.

18. The latch assembly according to claim 17 further comprising an operator for changing the latch element from the latched position into the release position.

19. A latch assembly comprising:

a housing; and a catch assembly on the housing;

the catch assembly comprising at least one catch element that is repositionable relative to the housing to change the catch assembly between first and second different states, the catch assembly in the first state capable of preventing a strike element engaged by the latch assembly from separating from the latch assembly, the housing comprising a base wall defining a support for at least a part of the catch assembly and having a first substantially flat surface bounding a component space within which the catch assembly resides, a cover wall having a second substantially flat surface facing the first substantially flat surface and bounding the component space, and a return wall having third and fourth oppositely facing surfaces respectively facing the first and second substantially flat surfaces, the base wall, cover wall, and return wall fixed in relationship to each other, one of the third and fourth oppositely facing surfaces facing into the component space, one of the third and fourth oppositely facing surfaces abutting to the return wall, wherein at least one axle is fixed on and projects from the base wall, wherein the at least one repositionable catch element comprises a rotor that is guided in pivoting movement by and relative to the axle between first and second positions, the rotor in the first position with the catch assembly in the first state and in the second position with the catch assembly in the second state.

20. The latch assembly according to claim 19 wherein the return wall resides between the base wall and cover wall.

21. The latch assembly according to claim 20 wherein the third oppositely facing surface faces into the component space and the fourth oppositely facing surface abuts to the second substantially flat surface.

22. The latch assembly according to claim 20 wherein the cover has a peripheral edge bounding an area and the cover is substantially flat over the entire area.

23. The latch assembly according to claim 20 wherein the housing further comprises a side wall extending between the base wall and return wall.

24. The latch assembly according to claim 20 wherein the housing has a length, a width, and a thickness, the base wall and cover wall extend over substantially the full width of the housing and the return wall extends over less than the full width of the housing.

25. The latch assembly according to claim 24 wherein the return wall extends over less than one half the width of the housing.

26. The latch assembly according to claim 20 wherein the housing has a generally U-shaped opening defined through each of the base wall and cover wall within which a strike element engaged by the catch assembly resides with the catch assembly in the first state.

27. The latch assembly according to claim 20 wherein the at least one axle connects between the base wall and cover wall to maintain the base wall and cover wall in a fixed relationship.

28. The latch assembly according to claim 20 in combination with a repositionable closure element to which the latch assembly is mounted, the repositionable closure element mounted for movement relative to a support with a strike element between first and second position and with the repositionable closure element in the first position the strike element is engaged with the catch assembly and the catch assembly is in the second state.

29. The latch assembly according to claim 28 further comprising a release assembly for selectively causing the catch assembly to be changed from the first state into the second state.

30. The latch assembly according to claim 29 wherein the rotor is movably biased toward the second position, and the catch assembly further comprises a latch element that is movable between a latched position and a release position, the latch element in the latched position preventing the rotor from moving from the first position into the second position, the latch element in the release position allowing the rotor to move from the first position into the second position.

31. The latch assembly according to claim 30 wherein the latch element is engagable with the rotor with the rotor in a third position between the first and second positions and with the rotor in the third position and the latch element in the latched position, the latch element prevents the rotor from moving from the third position into the second position.

32. The latch assembly according to claim 31 further comprising an operator for changing the latch element from the latched position into the release position.

* * * * *